United States Patent [19]

Savoir

[11] 4,432,455

[45] Feb. 21, 1984

[54] SUPPORT FOR TABLETS, CAPSULES, PILLS OR THE LIKE

[76] Inventor: Jean-Claude Savoir, 43, rue de Lausanne, 1201 Geneva, Switzerland

[21] Appl. No.: 321,174

[22] Filed: Nov. 9, 1981

[30] Foreign Application Priority Data

Mar. 11, 1980 [FR] France ..... 80 05425

[51] Int. Cl.[3] ..... B65D 83/04

[52] U.S. Cl. ..... 206/531; 206/528; 206/530; 206/303; 215/100 R

[58] Field of Search ..... 206/0.8, 199, 216, 303, 206/497, 528, 530, 531, 538, 539; 215/100 R

[56] References Cited

U.S. PATENT DOCUMENTS

| | | | |
|---|---|---|---|
| 2,250,666 | 7/1941 | Godefroy | 206/459 |
| 3,080,964 | 3/1963 | Robinson et al. | 206/303 |
| 3,387,699 | 6/1968 | Heller | 206/531 |
| 3,446,419 | 5/1969 | Mueller | 206/303 |
| 3,540,579 | 3/1970 | Helstrom | 206/62 |
| 3,797,658 | 3/1974 | Peacock | 206/216 |
| 4,213,531 | 7/1980 | Rae | 206/216 |

*Primary Examiner*—William T. Dixson, Jr.
*Assistant Examiner*—David Fidei
*Attorney, Agent, or Firm*—Robert E. Burns; Emmanuel J. Lobato; Bruce L. Adams

[57] ABSTRACT

A package is provided for supporting tablets, capsules, pills or the like. The package is formed by a disc having cut-out portions in which the tablets are placed and are held by two coatings covering each of the faces of the disc. An aperture is formed in the center of the disc intended for the introduction of the disc onto the neck of a bottle. In the alternative the support disc is constructed of two specially concentric members in which the tablets are placed and retained by two coatings applied to each face of the members. The tablets are easily removed by exerting a slight pressure on one of the sides of the disc to expel the tablet by tearing a sheet of coating.

3 Claims, 2 Drawing Figures

SUPPORT FOR TABLETS, CAPSULES, PILLS OR THE LIKE

The present invention relates to a support for tablets, capsules, pills or the like, constituted by a disc provided with cut-out portions in or on which the tablets or the like are held by two coatings covering each of the faces of the disc and through at least one of which the tablets may be taken out by pressure and tearing.

Packaging of this type is known for medicines and it is used primarily for separating the tablets, capsules or pills from each other and for protecting them from outside influences, whilst making it possible to remove a tablet easily, when required, by exerting slight pressure on one of the sides of the support in order to expel the tablet from the support by tearing a sheet of coating.

The object of the invention is to extend and distinguish the range of application of such supports. To this end, the support, in the form of a disc, according to the invention is provided with an opening intended for the introduction of the disc onto the neck of a bottle, container or the like.

It is thus possible to combine the support with the most varied bottles or containers comprising a neck, this support containing tablets, capsules, pills or the like having any relationship with respect to the contents of the bottle or of the container, but not having to be added to these contents before its use. For example the latter may be constituted by an additive intended to alter the taste, for example sweeteners or flavourings intended to mask the unpleasant taste of the contents of the bottle or gassifying additives, for example carbon dioxide, intended to give the contents of the bottle a refreshing taste. The latter may also be solid medicines intended to be taken at the same time as liquid medicines or simply with water which may not always be available to the user, for example when travelling.

The support according to the invention may be manufactured easily from a sheet of rigid material by known and simple methods, for example by stamping in a single pass, this support then being provided with tablets, capsules, pills or the like, like known supports for medicines and covered on two sides with a coating, one of which is constituted by a sheet of heat-shrinkable, transparent, synthetic material and the other by a thin sheet of aluminium which tears easily.

The accompanying drawings show two embodiments of the invention, by way of example.

Figure 1:
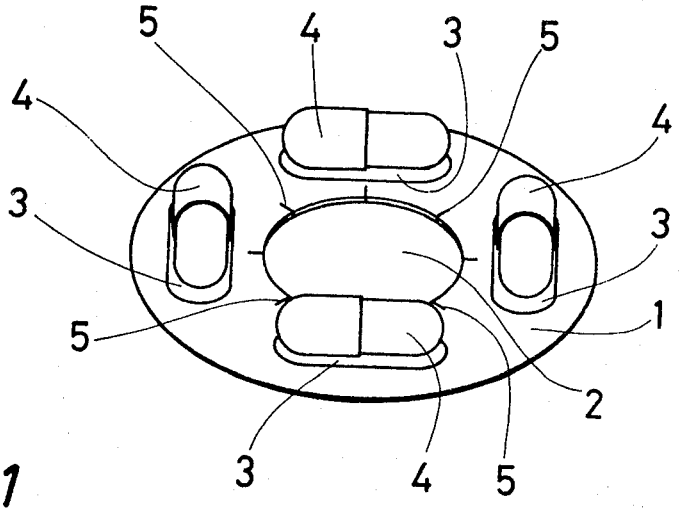
FIG. 1 is a vew from above and in perspective of a first embodiment.

The support shown in FIG. 1 comprises a circular, annular disc 1 which in addition to its central opening 2 comprises cut-out portions 3 the shape of which is adapted to the shape of the tablets, capsules or pills 4 which are disposed in or on the cut-out portions 3. These capsules or the like are held in the cut-out portions 3 in known manner between two coatings adhering to each face of the disc 1 and which have not been shown in detail in the drawing. The coating on the lower face of the disc is constituted for example by a sheet of aluminium which tears easily, so that the capsules 4 can be expelled from the support, through the cut-out portions, by a downwards pressure, thus tearing the sheet of aluminium.

The circumference of the central opening 2 is provided with several notches 5 on the one hand intended for the adaptation of the support, within a certain range, to various diameters of the bottle neck and on the other hand intended for obtaining a certain gripping action due to elastic deformation of the strips formed between the notches, when the support is fitted on the neck of a bottle or similar container.

Figure 2:
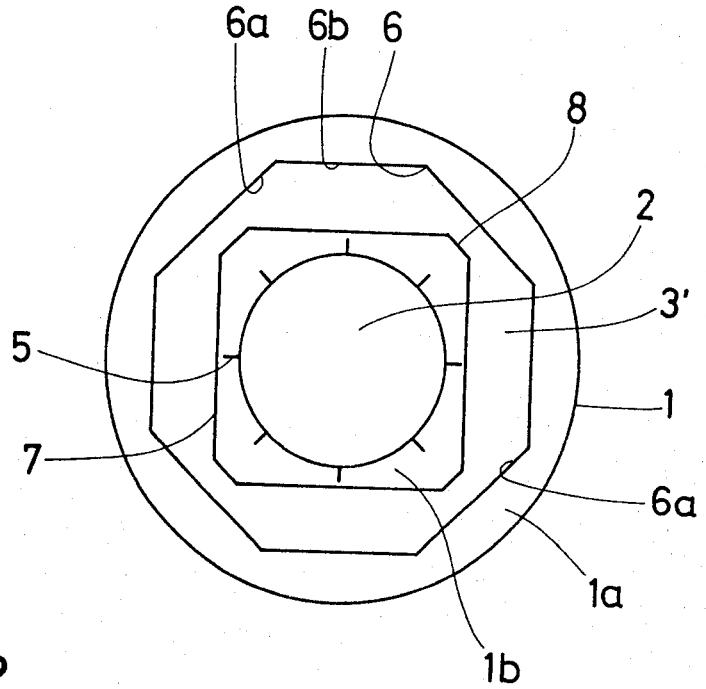
FIG. 2 is a view from below of a second embodiment, without its coating.

According to the embodiment illustrated in FIG. 2, the support disc 1 is constituted by two partial discs 1*a* and 1*b*, which solution may prove advantageous for reasons of manufacturing materials or techniques. The two concentric parts 1*a* and 1*b* are fixed relatively one with respect to the other by the coatings applied to their two faces. The concentric annular space between the two parts of the disc 1*a* and 1*b* may comprise radial enlargements in or on which the capsules or the like ar placed.

In the embodiment illustrated in FIG. 2, these radial enlargements 3' are obtained simply by the fact that the outer partial disc 1*a* has an octagonal cut-out 6 and that the outer contour of the partial disc 1*b* comes close to four of the opposite sides 6*a* of the octagonal contour, the cut-out portions 3' being formed along the other sides 6*b* of its octagonal contour.

In the case of a circular outer contour of the inner partial disc 1*b*, the cut-out portions 3' are relatively small, even if the diameter of this outer contour is smaller than the diameter of the circle inscribed in the octagonal contour. In the embodiment illustrated in FIG. 2, the openings 3' have been enlarged thus giving the contour of the inner disc 1*b* the shape of a square 7, whereof the diagonal is slightly smaller than the diameter of the circle inscribed in the octagon, the sides of this square being parallel to four of the sides of the octagon defining with these sides four cut-out portions 3'.

The corners of the square 7 may also be truncated, which makes it possible to increase the surface of the square and thus to reduce the width of the cut-out portions 3'.

Due to a suitable choice of the shape and dimensions of the inner contour 6 of the partial disc 1*a* and of the outer contour 7 of the partial disc 1*b*, it is possible to modify the dimensions of the cut-out portions 3', both radially as well as tangentially, in order to adapt them to the shape and dimensions of the capsules, tablets or the like.

The invention is not limited to a disc having a circular outer contour and a circular central opening, but these contours may have any other shape, for example they may be oval or polygonal, for example if they are intended to be fixed to necks of non-circular containers or to facilitate their packaging.

What we claim is:

1. Packaging for supporting tablets, capsules, pills or the like articles on the neck of a container, said packaging comprising an inner annular disc having a central opening of a size and shape to fit frictionally on the neck of a container, an outer annular disc surrounding said inner disc with article-receiving spaces between the outer periphery of said inner disc and the inner periphery of said outer disc, said articles being received in said spaces; and two coatings adhering respectively to opposite faces of said discs to unite said disc in a unitary packaging and retain said articles in said spaces.

2. Packaging according to claim 1, wherein the outer periphery of said inner disc is square and the inner periphery of said outer disc is octagonal, said spaces being provided between the sides of said square outer periphery of said inner disc and alternate sides of said octagonal inner periphery of said outer disc.

3. Packaging according to claim 1, wherein one of said coatings is a film of transparent synthetic material and the other of said coatings is a sheet of aluminum foil which tears easily to release said articles.

* * * * *